United States Patent [19]

Zagaroli

[11] 4,297,952

[45] Nov. 3, 1981

[54] EXPANDABLE TABLE

[75] Inventor: David Zagaroli, Hickory, N.C.

[73] Assignee: Zagaroli & Company, Hickory, N.C.

[21] Appl. No.: 95,253

[22] Filed: Nov. 19, 1979

[51] Int. Cl.[3] ..... A47B 1/02

[52] U.S. Cl. ..... 108/83; 108/65; 108/90

[58] Field of Search ..... 108/65, 83, 86, 89, 108/90, 102; 312/348, 333

[56] References Cited

U.S. PATENT DOCUMENTS

| | | | |
|---|---|---|---|
| 83,460 | 10/1868 | Carroll | 108/65 |
| 710,376 | 9/1902 | Smith | 108/86 |
| 3,504,642 | 4/1970 | Kovach | 108/65 |
| 3,769,919 | 11/1973 | Thomas | 108/83 |
| 3,974,782 | 8/1976 | Ruckriegel | 108/83 |
| 4,020,771 | 5/1977 | Hasenour | 108/86 |

*Primary Examiner*—James T. McCall

[57] ABSTRACT

A pair of planar members which form the surface of a table are arranged in co-planar relationship on flanges extending inwardly from the opposite side rails of a rigid, non-expandable frame. The two planar members are slidable between a first, closed position in which the adjacent edges of the two planar members abut each other and a second, open position with the planar members spaced apart. In the open position, a third auxiliary planar member, having a width equal to the first two and normally kept separate from the table, is inserted between the spaced adjacent ends of the planar members and supported on the flanges. The frame is formed of a pair of spaced side rails, end rails connecting the side rails, and four legs extending downwardly from the corners of the frame member.

A locking mechanism interconnects the side rails and the two planar members, so that the two planar members are held together in locked relationship in either the first position or the second position.

3 Claims, 3 Drawing Figures

EXPANDABLE TABLE

BACKGROUND OF THE INVENTION

In recent years, furniture with a more modern appearance has been developed which is a combination of finished metal and glass. In such type of furniture, tables, such as dining room tables, are formed with a finished metal frame and glass top. Problems have arisen in the design of such types of tables because of the transparency of the glass. In wooden type furniture the wooden upper surfaces could be separated with telescoping supporting rails therebeneath, and extra leaves inserted. When the table was then ready for use the opaque wooden leaves would cover up the telescoping rails.

Due to the nature of the transparency of glass, other arrangements must be made in order to expand a glass top table. One example of an expandable, chrome and glass table is illustrated and described in the U.S. patent to Thomas, U.S. Pat. No. 3,769,919. In the Thomas patent the table frame includes side rails which telescope and a rail cover member is positioned over the expanded portion of the side rails to make the appearance uniform throughout the length thereof.

SUMMARY OF THE PRESENT INVENTION

The present invention, on the other hand, is directed to a different approach for forming an expandable type glass and chrome table. Although the specification is directed to a table formed of glass and chrome, it is also apparent the concept taught herein might be applied to tables formed of any other material. In the present concept, the rectangular frame member is rigid and the rails thereof do not expand. Each of the rails include an inwardly turned flange which together support a pair of co-planar panels in abutting relationship in a first, closed position, yet allow the panels to slide apart for receipt of an auxiliary panel between the adjacent ends thereof. A locking mechanism extends between at least one of the side rails and the two panel members for locking the panels in the first, closed position or alternatively in the second, open position.

In general, then, the table according to the present invention includes a rigid rectangular frame formed of a pair of spaced side rails, end rails connecting the side rails, and four legs extending downwardly from the corners of the resulting frame. Each of the side rails are integrally formed and non-extensible, and include an inwardly turned flange extending the length thereof. A pair of planar top surface members rest on the aforementioned flanges and are movable on the flanges between a first, closed position in which adjacent edges of the planar members abut and a second, open position in which the adjacent edges of the planar members are spread apart. In the second position, an auxiliary planar member, normally kept separate from the table, is inserted between the spaced adjacent ends of the planar members to form the expanded table surface.

In order to provide a contemporary simplicity of appearance the upper surface of the end rails and the flanges extending inwardly from the side rails are preferably substantially co-planar. Also the vertical distance between the aforementioned plane of the end rails and side flanges and the upper surface of the side rails are substantially equal to the thickness of the planar members whereby the upper surface of the planar members and the corresponding surface of the side rails are substantially co-planar. Further, in order to provide a pleasing appearance the combined length of the two planar members in the closed position is preferably equal to the length of the side rails whereby the opposed ends of the planar members and side rails are substantially co-extensive.

The aforementioned locking means includes a pair of spaced pins (one for each planar member) secured to at least one of the side rails. Each of the pins extends inwardly into locking relationship with the side edge of one of the planar members. At least one side edge of each planar member includes a pair of spaced slots therein into which the pin is selectively received, whereby the pin is inserted into one of the slots in the first, closed position and into the second of the slots in the second, open position.

It is therefore an object of the present invention to provide a very simple, expandable table which has a unique appearance and operation.

It is a second object of the present invention to provide an improved, expandable table, adapted for chrome and glass construction, which table does not require expansion of the frame members.

It is another object of the present invention to provide an expandable table of the type described, adapted for chrome and glass construction, wherein the table surface opens and permits insertion of an auxiliary surface member to provide a longer table surface.

Other objects and a fuller understanding of the present invention will become apparent upon reading the following detailed description of a preferred embodiment along with the accompanying drawings in which.

DETAILED DESCRIPTION OF A PREFERRED EMBODIMENT

Figure 1:
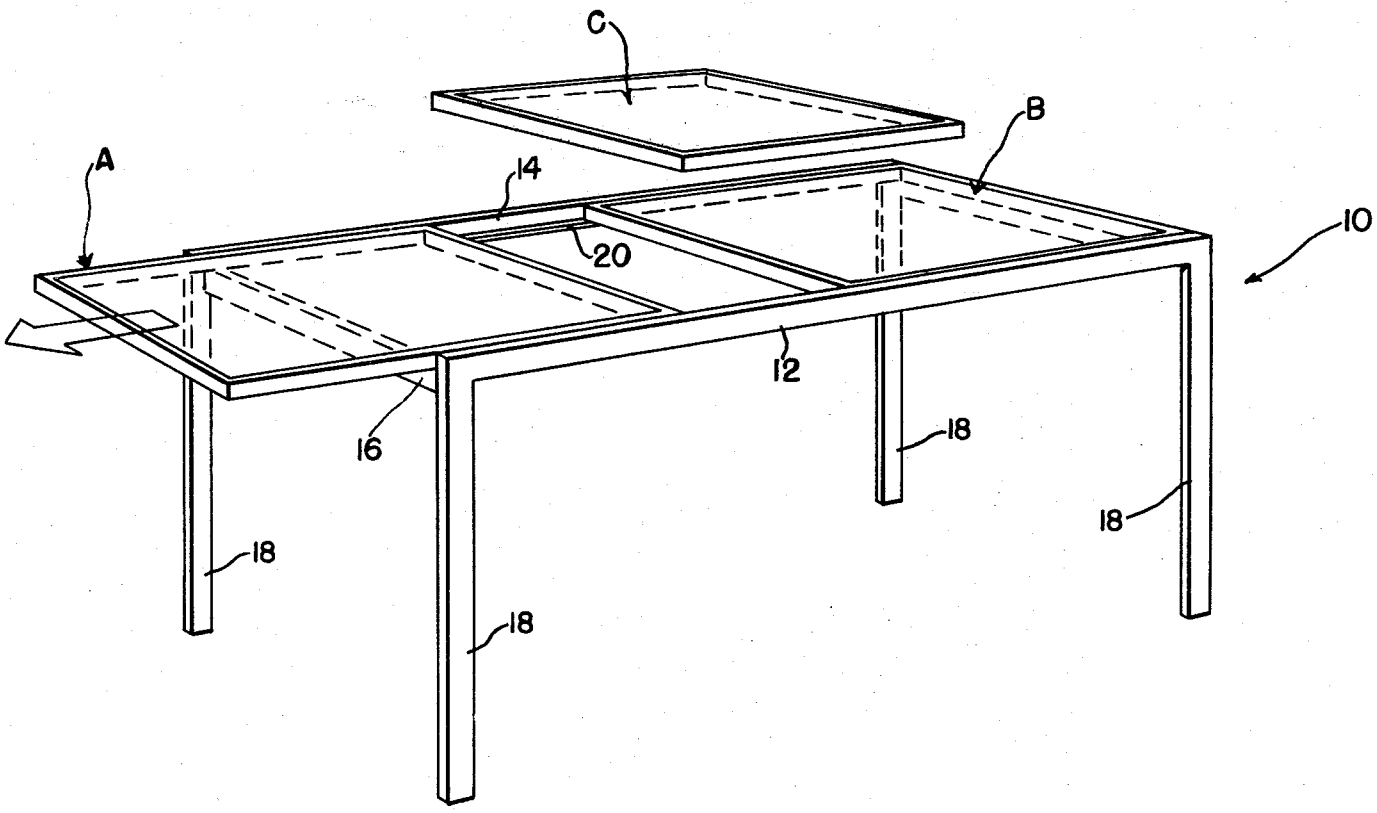
FIG. 1 is a perspective view illustrating the table according to the present invention with one of the upper planar members in the closed position, one of the upper planar members in the open position, and illustrating an auxiliary surface member exploded therefrom.

Turning now to the drawings, and particularly to FIG. 1, there is shown an overall view of the entire table according to the present invention. In general, the table includes a rigid frame 10 onto which are mounted a pair of sliding panels A and B which form the table surface. When panels A and B are slid along the frame to separate, an auxiliary surface panel C may be inserted therein to extend the length of the table surface.

Frame 10 is generally rectangular in shape and includes a pair of longitudinally extending, spaced side rails 12,14, separated and connected by a pair of spaced end rails 16. From FIG. 1 it can be noted that the end rails 16 are spaced below the upper surface of side rails 14 for reasons to be described hereinafter. Legs 18 extend downwardly from each of the corners of frame 10 to provide conventional support for the table. Inturned flanges 20 extend inwardly from each of side rails 12,14 along the length thereof to provide a horizontal support surface for slidably receiving panels A,B.

Figure 2:
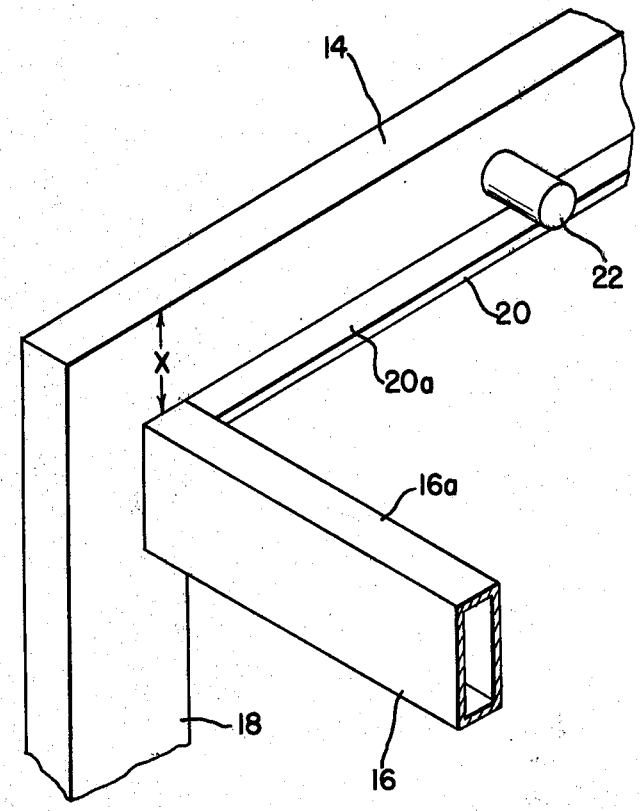
FIG. 2 is an enlarged perspective view, with parts broken away, illustrating one corner of the table, a portion of the side rail, with the associated planar member removed therefrom.

As can best be seen in FIG. 2, a pin 22 extends inwardly from the rail 14 (and preferably also from rail 12 although not shown) to provide the locking relationship as described hereinbelow. Further, as is evident from an inspection of FIG. 2, the upper surface 16*a* of end rails 16 is preferably co-planar with the upper surface 20*a* of inturned flanges 20, so that panels A,B rest on the flanges 20 and end rails 16 simultaneously. However, obviously the flanges 20 can support the panels A,B alone without support from end rails 20, which could be even lower in other embodiments. The surface 20*a* and preferably the surface 16*a* are spaced from the upper surface of side rail 14 a distance x which is equal to the thickness of panels A and B. So arranged, when in the closed position panels A,B and the upper surfaces of side rails 12,14 form a co-planar upper surface which leads to the contemporary simplified appearance of the table. Further, the side rails 12,14 are preferably equal in length to the combined corresponding length of panels A,B so that the outer ends of panels A,B are co-extensive with the ends of side rails 12,14 when in the closed position.

Figure 3:
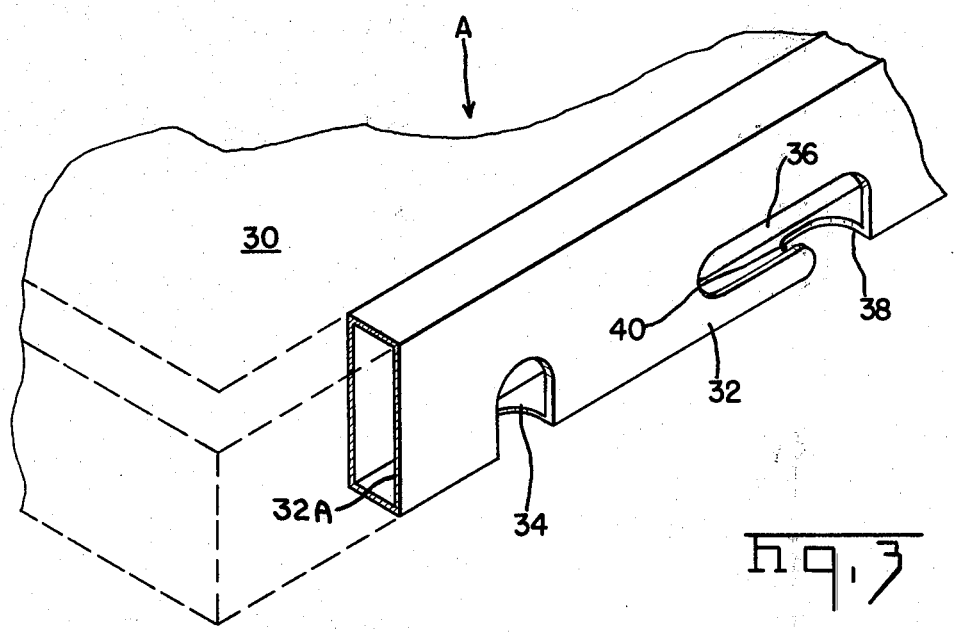
FIG. 3 is an enlarged perspective view of a portion of the side edge of one of the planar members forming the table surface illustrating the slots forming the locking mechanism therein.

Turning now to FIG. 3, there is illustrated one of the panels A which includes in the preferred embodiment a glass plate 30 inlaid or otherwise secured onto the rectangular chrome frame 32, which is preferably tubular in cross-section, but might be solid or any other configuration. The sides of frame 32 which are adjacent rail 12 include a pair of spaced slots 34,36 which open at the downward edge of frame 32 and extend up into one wall 32*a* for a prescribed distance into the frame. Slot 34 is merely a plain inverted U-shaped slot which is slightly greater in cross-sectional dimension than the diameter of locking pin 22. The second slot 36 is slightly different in configuration to include an access opening 38 through the bottom edge of side frame member 32, then an elongated rearwardly extending portion 40 which extends back toward the aforementioned slot 34. Both the access opening portion 38 and the rearward extending portion 40 are approximately equal in width, but slightly greater than the diameter of pin 22. It should be noted from FIG. 3 that slots 34,36 are only in the wall 32*a* adjacent the side rail 12 or 14. Therefore, since the slot does not extend through the entire thickness of frame 32, the locking means is concealed from view. This is very important from a marketing standpoint.

The combination of slots 34, 36 and pin 22 form the aforementioned locking means and operate in the following manner. In the closed position the locking pin 22, which may extend inwardly from side rail 12, from side rail 14, or from both, extends into the first slot 34 for locking the table in the closed position. To move the panel A to the open position, it is first lifted to clear pin 22 from slot 34, then slid longitudinally until pin 22 slides into groove 38. After the auxiliary panel C has been emplaced panel A is moved in the opposite direction so that the pin moves into the portion 40 of slot 36 and is positively locked therein. Release of the frame 32 is effected by lifting slightly to release the pin from one of the slots.

The locking arrangement with pin 22 and slots 34,36 is preferably provided for each side of the frame 32 of both panels A and B so that a more even, aligned arrangement is achieved. However, it is possible that the locking arrangement could be provided merely in one side of each panel and still be effective. Also, as explained hereinabove in the preferred embodiment the panels or planar members A,B include a chrome or steel frame 32 which holds a glass upper surface 30 therein. Alternatively, the panels could be wooden, or most any other material, the invention being directed to the way in which the table surface is extended rather than the material from which is it formed.

While a preferred embodiment of the present invention has been described in detail hereinabove, it is obvious that changes and modifications might be made to the structure illustrated and described without departing from the scope of the invention which is set forth by the claim hereinbelow.

What is claimed is:

1. An expandable table comprising:

(a) a frame member including a pair of spaced side rails, end rails connecting said side rails, and four legs extending downwardly from the corners of said frame member;

(b) each of said side rails being integrally formed and non-extensible, said side rails each including an inwardly turned flange extending the length thereof;

(c) an expandable table surface including two planar members resting on said flanges and movable between a first, closed position in which said planar members are arranged in co-planar relationship with adjacent edges abutting and a second, open position with said planar members spread apart along said flanges, but still in co-planar relationship;

(d) an auxiliary planar member, similar in appearance to said two planar members and separate from said table when in said first position but inserted between spaced adjacent ends of said planar members when in said second position;

(e) a locking means connecting said side rails and said first two planar members for securing said planar members in said first position and said second position;

2. The table according to claim 1 wherein said locking means includes a pair of spaced pins secured to at least one of said side rails, each of said pins extending inwardly into cooperating relationship with the side edge of one of said planar members, each of said planar members including at least one side edge having a pair of spaced slots therein into which said pin is selectively received, whereby said pin is inserted in one of said slots in the first position and into the second of said slots in the second position.

3. The table according to claim 2 wherein said planar members and said auxiliary planar member comprise a rectangular, tubular metal frame surrounding and receiving a glass plate; and said pair of spaced walls occurring in the exterior wall only of said tubular metal frame adjacent said side rails, whereby the locking means is concealed from view.

* * * * *